US005079804A

United States Patent [19]

Gregurich et al.

[11] Patent Number: 5,079,804

[45] Date of Patent: Jan. 14, 1992

[54] BUNDLING TIE

[76] Inventors: Don L. Gregurich, 1918 Rowley Ave.; Patrick M. Donnelly, 4320 Hillcrest Cir., both of Madison, Wis. 53705

[21] Appl. No.: 545,244

[22] Filed: Jun. 28, 1990

[51] Int. Cl.[5] ..... B65D 63/10

[52] U.S. Cl. ..... 24/17 AP; 24/16 PB

[58] Field of Search ..... 24/16 PB, 16 R, 17 AP, 24/17 R, 30.5 R, 30.5 P, 17 A; 248/74.3; 100/1, 34

[56] References Cited

U.S. PATENT DOCUMENTS

| | | | |
|---|---|---|---|
| 414,845 | 11/1889 | Reynolds | 24/17 A X |
| 2,371,920 | 3/1945 | Trevisan . | |
| 2,532,306 | 12/1950 | Herbert . | |
| 3,072,986 | 1/1963 | Lefnaer . | |
| 3,086,265 | 4/1963 | Orenick et al. . | |
| 3,092,163 | 6/1963 | Bunker, Jr. et al. | 24/16 PB X |
| 3,402,435 | 9/1968 | Merser . | |
| 3,467,427 | 9/1969 | Moberg . | |
| 3,568,980 | 3/1971 | Hulbert et al. | 248/74.3 X |
| 3,597,803 | 8/1971 | Van Neil . | |
| 3,850,092 | 11/1974 | Montgomery . | |
| 3,865,292 | 2/1975 | Foley . | |
| 3,897,724 | 8/1975 | McDonald . | |
| 3,913,178 | 10/1975 | Ballin . | |
| 3,944,269 | 3/1976 | Lundberg | 24/16 PB X |
| 4,150,612 | 4/1979 | Kessler . | |
| 4,167,903 | 9/1979 | Lasher . | |
| 4,183,119 | 1/1980 | Stewart et al. . | |
| 4,183,121 | 1/1980 | Cousins . | |
| 4,193,340 | 3/1980 | Finn . | |
| 4,235,404 | 11/1980 | Kraus | 24/16 PB X |
| 4,347,648 | 9/1982 | Dekkers . | |
| 4,395,941 | 8/1983 | Metzger . | |
| 4,477,950 | 10/1984 | Cisek et al. . | |
| 4,641,646 | 2/1987 | Schultz et al. | 24/17 AP X |
| 4,681,032 | 7/1987 | McDermott . | |
| 4,684,163 | 8/1987 | Anderson . | |
| 4,711,002 | 12/1987 | Kreeger . | |
| 4,788,751 | 12/1988 | Shely et al. . | |

FOREIGN PATENT DOCUMENTS

| | | | |
|---|---|---|---|
| 864348 | 4/1961 | France | 24/16 PB |
| 1287485 | 1/1962 | France | 24/16 PB |

*Primary Examiner*—James R. Brittain

*Attorney, Agent, or Firm*—Quarles & Brady

[57] ABSTRACT

A bundling tie is disclosed which is useful for the bundling of stacked articles, such as used newspapers for recycling. The bundling tie is a molded plastic article with a plurality of legs, the legs having a coiled region of sinusoidal planar coils so that the bundling tie is a flat and compact article as provided to the user. The coiled region of the legs may be deformed by the user by stretching to ultimately extend around the bundle of articles. The legs also include fasteners to fasten the ends of the legs together to secure the bundle. The bundling tie may be provided as a kit including a stacking fixture intended to further facilitate the use of the bundling tie.

9 Claims, 6 Drawing Sheets

BUNDLING TIE

FIELD OF INVENTION

This invention relates to hand-applied bundle ties used for tying stacks of articles into bundles, and also a bundling kit with a receptacle for accumulating, stacking, and holding articles for tying, to be used in conjunction with the bundling tie.

BACKGROUND OF THE INVENTION

There are many circumstances in which stacks of papers or other articles are tied into bundles for easy transport and/or storage. The circumstances of particular interest here are one-time uses. In particular, used newspapers are routinely bundled by the newspaper user for collection and recycling. As a result of the societal interest in recycling, in many municipalities bundling of used newspapers for recycling is mandatory.

Heretofore, papers have been tied in bundles using string or cord cut to length and knotted. This is a rather time consuming and inconvenient task, requiring a cutting tool, manipulation of the bundle when wrapping with string, and tying of the knot while trying to keep the string taunt (usually resulting in a less tightly tied bundle than desired). Also, a heavy bundle which is tied with string cannot be comfortably carried by grasping the string. There have been previous attempts at improving this process. One handle/tying aid is shown in U.S. Pat. No. 2,371,920. However, the use of this additional device does not significantly simplify the chore of the bundling procedure using string.

As alternatives to string, there are various strapping assemblies that have been devised for carrying papers, books, mail, and the like, such as U.S. Pat. Nos. 4,684,163; 3,865,292; and 2,532,306. These designs have been principally intended for reusable applications. For example, the straps of U.S. Pat. No. 4,684,163 are manufactured by a process, and made of a material, which would be too expensive for a single-use device. There are also various strapping or banding machines and tools available, but these are not appropriate for individual low-volume applications because of cost.

One class of existing devise suggested as useful for bundling papers are flexible plastic ties (harnessing devices) which have integral latching features. There are a number of styles of self-locking plastic ties which could be adapted for use for bundling newspapers, although none of these are currently marketed specifically for that purpose. These styles may be categorized into two groups: 1) individually injection molded ties, i.e. harassing devices; 2) ties made from extruded plastic, and modified to incorporate locking features.

The molded ties in the first group typically consist of a long flexible strap with a clasp at one end. A loop around a stack or bunch of articles is formed by threading the strap through the clasp. The flexible strap has a profile which enables it to travel through the head in one direction only. A locking mechanism in the clasp engages the profile to prevent travel in the opposite direction. These ties are easy to thread, adjust, and tighten, and the snap fit of the locking mechanism onto the strap is a strong connection. Examples of these devices are shown in U.S. Pat. Nos. 3,467,427; 3,597,803; 4,183,119; 4,347,648; and 4,788,751.

There are some shortcomings in attempting to use these prior designs of molded ties for bundling newspapers. A strap must be about 106 centimeters (43 inches) long in order to encircle and cinch around a 6 inch high stack of newspapers in the lengthwise direction. A very large, and therefore expensive, mold would be required to make a one-piece tie of this length. Alternatively, long lengths could be produced either by stretching a molded piece, or by joining two shorter pieces. However, these extra operations would increase the cost. These long ties would not be convenient to package, and they would not be easy to handle by the end user. Also, in order to form a secure bundle, two of the ties would need to be used, one widthwise and one lengthwise, around the bundle.

A single strap around used newspaper is not adequate to form a secure bundle. The variation in size of the individual pieces of paper, and the flexibility of the stack, will cause a single strap to move off center when lifted. Some papers may then fall out of the stack. This is also true for stacks of mail. Stacks of stiffer articles, such as phonograph record albums or magazines, require two straps, because their smooth surfaces may cause them to slide to one side. There are currently no one-piece plastic ties with criss-crossed straps available on the market. The problems of molding and handling long lengths of strap delineated above would be even greater for a crossed-pattern piece.

The ties in the second group are straps generally made of flat extruded material, which are cut so as to enable two parts of the tie to be linked together. Examples are given in U.S. Pat. No. 3,913,178; 4,477,950; and 4,183,121. These ties are adjustable, and releasable, but require more manipulation to thread and tighten than those of the first style. The locking connection is accomplished by interlocking of two mating contours which overlap one another.

Although appropriate lengths of extruded-type bundling ties could be easily manufactured, handling by the end user would still be inconvenient. The use of two ties of this style is required in order to make a secure bundle. Another disadvantage of the extruded tie designs is the relative lack of strength of the locking connection, as compared to the molded harnesses of group one above. In order to provide enough strength to support a bundle of newspapers, the strap would need to be relatively wide and thick, requiring substantially more plastic material than most molded ties of comparable strength.

An added difficulty with extruded bundle ties arises from the way they lock on the bundle. In order to form a tight loop with the extruded ties, both ends of the tie must be grasped and pulled tight before the locking mechanism is engaged. The tension must be maintained on the tie by the user until the locking mechanism is engaged. Once the mechanism is engaged, further tightening requires disengagement of the mechanism, and then retightening and reengaging. This differs from the molded ties which, once engaged, can be cinched tightly by pulling on the free end as desired.

The device of U.S. Pat. No. 3,072,986 represents a hybrid of the two styles of ties referred to above. Although injection molded, it utilizes a clasping mechanism with the characteristics of the extruded ties. The device addresses the issue of the long lengths required for wrapping bundles, by incorporating a feature which enables individual ties to be linked together to form longer ties. For tying newspaper-size bundles, the user would be faced with first linking together several of these ties for each of the two loops around the stack.

This patent also proposes that two interlocking loops around a bundle could be formed by using one very long tie, rather than a string of ties, and wrapping the bundle in both directions with it. The disclosed method would involve threading the entire length of strap required for the second loop through the hole in the tie, prior to using that length to form the second loop. In addition, manipulation of the stack would be required in the process of making that loop. Further, the "handle" formed by this device indicated would not be comfortable to grasp, due to the projecting knobs which are an inherent feature of the tie.

Another kind of device is described in U.S. Pat. No. 4,681,032. This "bundling device" is essentially a mount which holds individual ties in positions perpendicular to one another so as to form a cross. The manufacturer must load this device with ties (alternating one tie in each direction), secure the ends of the gangs of ties, and package the entire assembly. These operations would result in considerable additional cost over that of the ties themselves. Alternatively, if the user is to load the ties into this "bundling device," the ties must be inserted one at a time and the ends of the ties must also be secured or managed, and maintained in the correct sequence. Note that for the manufacturer to provide assembled gangs of ties for insertion by the end user, the same operations by the manufacturer would be required as if providing the loaded "bundling device."

In many bundling applications the normal behavior of people is such that the articles to be bundled will accumulate over time. There are receptacles on the market which provide convenient means of neatly accumulating and stacking papers prior to tying in a bundle. These stacking devices act as an aid in orientating the papers, and in some cases they orientate the tying means in a position favorable for tying.

There are various stacking devices intended specifically for newspapers. U.S. Pat. Nos. 3,897,724, 4,681,032, 4,395,941, 4,193,340, and 4,167,903 illustrate examples of such devices. These stackers essentially consist of an appropriately sized box, or cradle, for containing a stack of papers, with features which enable the use of tying devices upon the articles while they are inside the stacker. The function of the features is to hold a tie (or string) in a correct position for use and to hold additional ties (or string) for use on successive stacks. However, since the placement of the straps into the appropriate positions in the stacker must be done by the user, the stacker does not effectively improve the convenience of the tying procedure. The stacker is only as good as the tying device for which it is designed, and the shortcomings of the tying devices have been described above.

The stacking device in U.S. Pat. No. 4,681,032 requires that the user position and connect an assembly of ties (actually a "bundling device" with ties) in the stacking device. The center connection must be made with some care in order to insure the proper orientation of the ties, and the connections on the four sides must be such as to both hold the ties in position and hold down the ends of the ties which extend well beyond the end of the top of the box.

In the existing stacking devices, the tied bundle must be removed before the next group of papers can be accumulated for stacking. Therefore the existing stackers provide only limited storage.

SUMMARY OF THE INVENTION

The bundling tie of this invention is a hand-applied device for conveniently tying stacks of articles into bundles. It is particularly suited for one-time uses and for tying newspaper-size bundles. It can be made from a plastic which is recyclable. In the preferred embodiment it is comprised of two pairs of flexible plastic legs emanating from its center. The long legs are molded in a coiled pattern in a manner which minimizes the overall size of the unused bundling tie. The legs are stiff enough to retain their coiled shape during handling, but yet are flexible enough to be easily stretched out to their full length for use by the consumer.

In using the bundling tie, each leg of a pair of legs is stretched out and then wrapped around one side of a stack of articles, and is then secured to the other leg of the pair. In this manner, a loop is formed around the stack. The legs have clasping features common to molded plastic ties, which allow them to be adjustably attached to one another, so that the loop which is formed can be tightened around the bundle. One of the pairs of legs is used to form a widthwise loop around the stack of articles, and the other pair of legs forms a lengthwise loop.

A handle may be easily incorporated into the bundling tie so that the bundle can be conveniently carried. Various handle designs may be used. In the preferred embodiment, there is a wide flat section in one of the legs of the ties which serves as a handle.

A principal use of the bundling tie of the present invention is for bundling used newspapers which are to be recycled. Bundling of newspapers is usually required so that they can be handled during the collection process. The present bundling tie fosters the recycling of newspapers because it makes bundling very easy for the user.

In the newspaper recycling process, all tying devices are removed prior to recycling of newspapers for newsprint. String, cord, and plastic bags are contaminants in the processing, and they are separated out manually or by machine. The contaminants must be disposed of as waste. The present bundling tie would be removed from the bundles of newspaper during the recycling process, just as string is now removed. However, unlike string, which becomes waste, the bundling tie here is made from a plastic which is itself recyclable by existing processes. The scrap bundling ties would thus accumulate at the recycling locations used for newspapers.

It is accordingly a prime object of the present invention to provide an inexpensive bundler, which can accommodate newspaper-size bundles, and yet is easy to manufacture, package, store, and handle because it is compact in size.

It si a further object to provide a bundling tie which can be used for form securely wrapped bundles, even with large articles of nonuniform size because two connected, criss-crossed loops are formed around the bundle. Further, the two loops can be easily tightened. Further, the bundling tie can be designed so that the two loops can be linked together at a second point around the bundle.

It is a further object to provide a bundling tie which can be used to comfortably carry the bundle because it has a built-in handle.

It is a further object to provide a bundling tie which can be designed for a single use application, or for a reusable application by use of a clasp which is releasable.

It is a further object to provide a bundling tie which can be advantageously used with a stacking device.

Other objects, advantages and features of the present invention will become apparent from the following specification when taken in conjunction with the accompanying drawings.

DESCRIPTION OF THE PREFERRED EMBODIMENT

Figure 1:
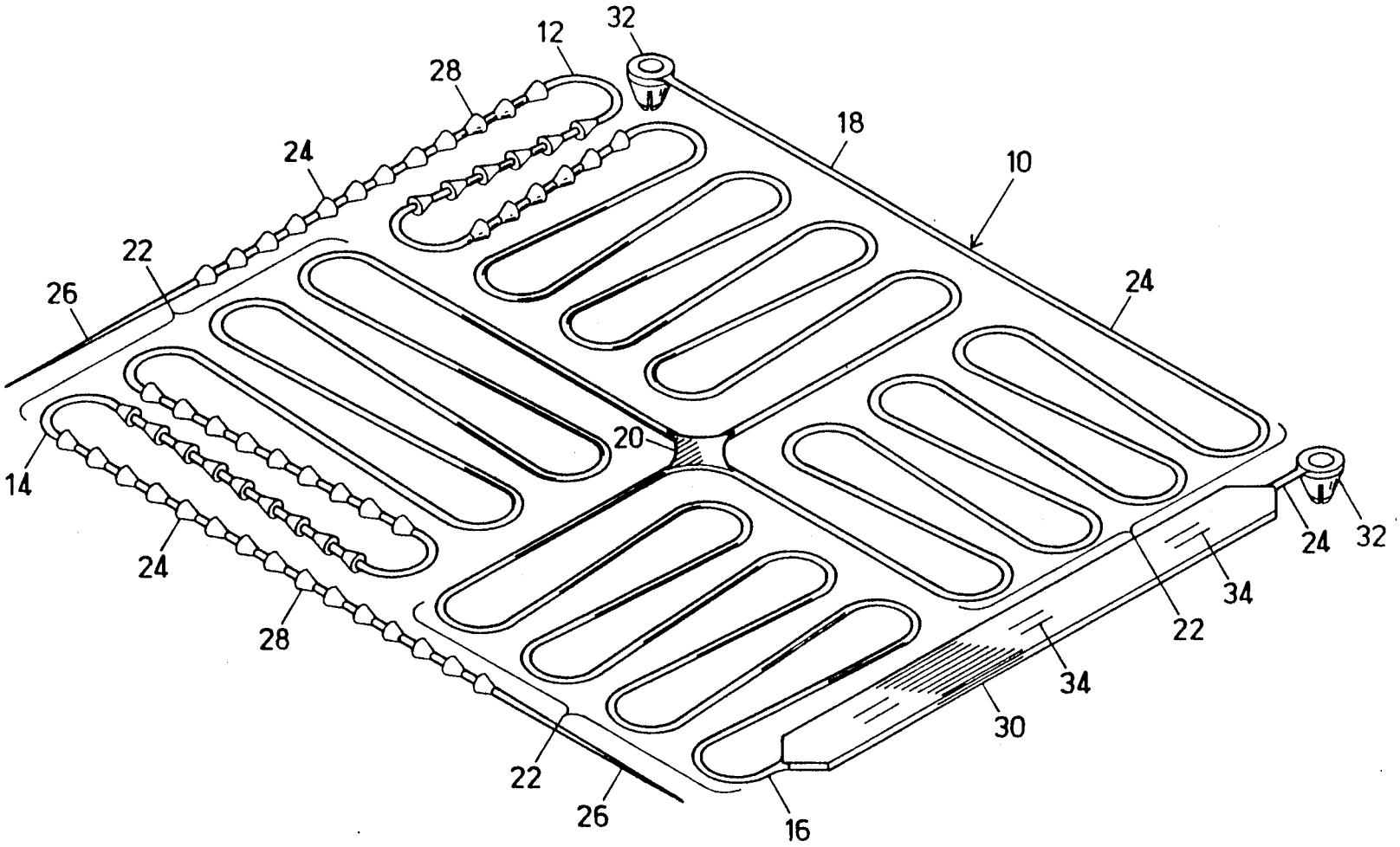
FIG. 1 is a perspective view of a bundling tie constructed in accordance with the present invention.

Illustrated in FIG. 1 is a bundling tie 10 constructed in accordance with the principles of the present invention. The bundling tie 10 is manufactured, stored, distributed, and sold in a configuration such as that shown in FIG. 1. The bundling tie 10 has structure and is adapted, so that it can be manufactured as an injection molded article integrally molded in the configuration of the single piece illustrated in FIG. 1. From that configuration, in which it is compact and easy to ship and store, it can be stretched for utilization as a bundling tie as will be described below.

The bundling tie 10 includes four separate legs 12, 14, 16, and 18. Each of the legs 12, 14, 16, and 18 includes an inward end and an outward end, with the inward end of each of the legs 12, 14, 16, and 18 is joined to a central juncture 20 located in the center of the bundling tie 10 as illustrated in FIG. 1. The innermost portion of each of the legs 12, 14, 16, and 18 extends radially outward from the central juncture 20, with the legs disposed so that they are equally radially distributed around the central juncture 20, emanating in four outwardly directions.

Each of the legs 12, 14, 16, and 18 includes two regions, a coiled region 22 and a fastener region 24. The two regions 22 and 24 may overlap. This can be seen clearly with regard to the leg 12, which extends outward at its end to a lead point 26. On the leg 12, inwardly from the lead point 26, is the fastener region 24, which extends and overlaps with the outward edge of the coiled region 22 of the leg 12. On other legs, the coiled region 22 and the fastener region 24 do not overlap, as for example with the leg 16. Within the coiled region 22 of each of the legs 12 through 18, the leg consists of an elongated thin strand of integrally molded plastic material which has been formed in a coiled or serpentine pattern. As can be seen by referring to FIG. 1, the serpentine pattern forming the coiled region 22 of each of the legs consists of a meandering or sinusoidal pattern of alternating hairpin curves and relatively linear regions. The net result of the serpentine pattern is that the coiled region 22 of each of the legs when formed in the single plane as in the bundling tie 10 of FIG. 1, occupies a minimal square surface area within the plane of the object, while achieving a maximal overall length of the leg in the portion between the central juncture 20 and the fastener region 24.

As also may be seen by referring to FIG. 1, the serpentine pattern making up the coiled region 22 of each of the legs is oriented at right angles to the pattern of each of the adjacent legs, so that the direction of extension of the leg when the coiled region 22 of each leg is pulled outward will be away from each of the adjacent legs.

Figure 2:
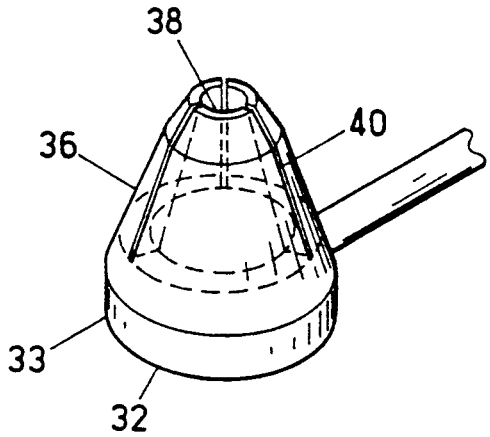
FIG. 2 is an enlarged perspective view of one of the clasps of the of FIG. 1.

Each of the legs 12, 14, 16, and 18 also includes a fastener region forming the outward portion of each such leg. In the leg 12, the fastener region includes at its outwardmost end a stiff tapering lead point 26, behind which are disposed a plurality of ridges 28. The ridges form the bulk of the fastener region 24 of the leg 12, and also extends the fastener region 24 of the leg 12 to overlap with the coiled region 22 of that same leg. Again, on the leg 14 the fastener region 24 consists of a lead point 26, behind which is disposed a plurality of ridges 28 which are similar to those formed on the leg 12. On the leg 16, the fastener region 24 consists of a flattened planar strip 30 of integrally molded material formed in the bundling tie 10, with a clasp 32 positioned at the far extreme of the leg 16. The flat strip 30 includes a series of pairs of slots 34, which are parallel to each other and extend along the long axis of the flattened strip 30. There are three of the pairs of slots 34 on the flat strip 30 of the leg 16 as viewed in FIG. 1. The clasp 32 is shown in greater detail in FIG. 2. It includes an annular ring 34 at its base and an upwardly extending frusto-conical outer body tapering to an insert hole 38 formed at the top thereof. A series of die cuts 40 are provided on the peripheral sides of the frusto-conical tapering portion 36, so as to provide the clasp 32 with suitable flexibility. The leg 18 has an elongated fastener region 24 also terminating in a clasp 32 of the same style as viewed in FIG. 2.

As stated previously, the bundling tie 10 of FIG. 1 is manufactured, stored, shipped, and distributed in the configuration as viewed in FIG. 1. It is formed of semi-flexible thermoplastic molded material of a type which will have a "memory," in that it will tend to return to its original configuration as molded, but which has sufficient flexibility so that it may be deformed from its original configuration into other configurations. A thermoplastic resin with good flowability and flexibility, such as polyethylene, is thus required. Such a resin is preferably also recyclable should the binding tie 10 be used for recycling operations. It is desired that the material and the cross-sectional size of the plastic within the coiled regions of each of the legs 12 through 18 is selected to be of a size such that it may be stretched into a deformed and lineal straight shape without undue effort by a user of the bundling tie 10. The exact cross-sectional area necessary to achieve the necessary balance between this desired flexibility, and the need for considerable strength, will be within the skill of a designer of ordinary skill in the art of molding such plastic devices depending upon the characteristics of the plastic chosen for the bundling tie 10.

Figure 3:
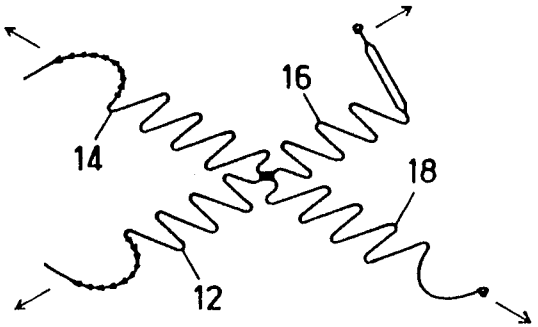

The manner of use of the bundling tie 10 is illustrated in FIGS. 3 through 6. To begin the operation the bundling tie of FIG. 1 is simply placed on the ground, a table, or other similar flat planar surface. Then the user extends and permanently deforms the legs 12, 14, 16, and 18. In this regard it should be noted that each of the legs is diametrically opposed from an opposite leg extending from the central juncture 20. Thus, the legs 12 and 16 are opposite, while the legs 14 and 18 are opposite. Thus, it is possible to pull the legs 12 and 16 in opposite directions radially outward with the force of the two hands, one hand on each of the legs, causing the extension of the coiled regions 22 in each of the two legs. Again assuming that the plastic and the cross-sectional size of the legs is chosen appropriately, the user will be able to deform the plastic of the legs so that while the two stretched legs may resiliently rebound from the maximum extension of stretch on them imposed by the user, they will not return to the original configuration illustrated in FIG. 1. Thus by stretching outward first the legs 12 and 16, and then the legs 14 and 18 in unison, the user will enlarge the size of the bundling tie 10 to a much larger, more relaxed and less coiled configuration, as generally illustrated in FIG. 3. Note that it is desirable to prestretch the legs before placing the newspapers on the bundling tie, in the configuration as shown in FIG. 3, in order to have easy access to the fastening devices at the ends of the legs 12 through 18.

Figure 4:
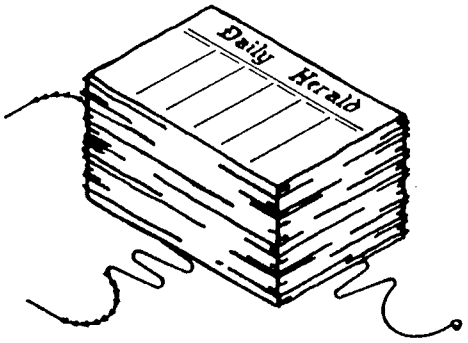
FIGS. 3 through 6 illustrate a method of bundling a stack of the bundling tie of FIG. 1.
Figure 6:
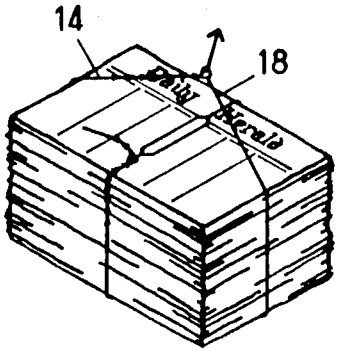
Figure 5:
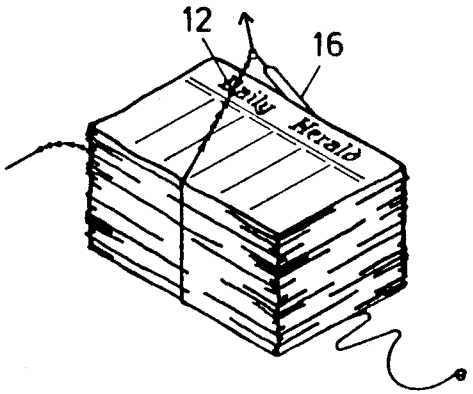

Shown in FIG. 4 is the placement of the stack of bundle of articles, such as newspapers for recycling, upon the bundling tie 10. The ends of each of the legs which have been previously deformed now extend outward from underneath the bundle of newspapers. When the stack of articles reaches the desired height, the ends of the legs are further extended and, as illustrated in FIG. 5, the ends of the legs are fastened to each other. To accomplish this fastening, the lead point 26 of the leg 12 is threaded through the clamp 32 of the leg 16, followed by the fastener region 24 with its ridges 28. As the ridges 28 pass through the clamp 32, the clamp 32 elastically deforms to permit the bulging ridges 28 to pass therethrough. Reverse passage of the ridges 28 through the clamp 32 is prevented by the conical shape of the clamp itself. Thus the clamp 32 locks on the appropriate portion of the fastener region 24 of the leg 12, when the leg 12 is firmly pulled through the clasp 32, so as to hold the newspapers tightly bundled therein. Similarly, by extending the legs 14 and 18, and extending the fastener region of the leg 14 through the clasp 32 of the leg 18, a similar tightly bundled wrap around the newspaper bundle is achieved, as can be viewed in FIG. 6. When all four of the legs are fastened in this manner, a tightly bundled stack of articles is achieved. Note that the handle formed by the flat strip 30 is now available for ready utilization by the hand of the user, so that the bundle can be readily picked up and transported conveniently by means of that handle. If desired the fastener region of the leg 14 can be inserted through one of the pairs of slots 34 on the flat strip 30 to further lock the four legs together.

Figure 7:
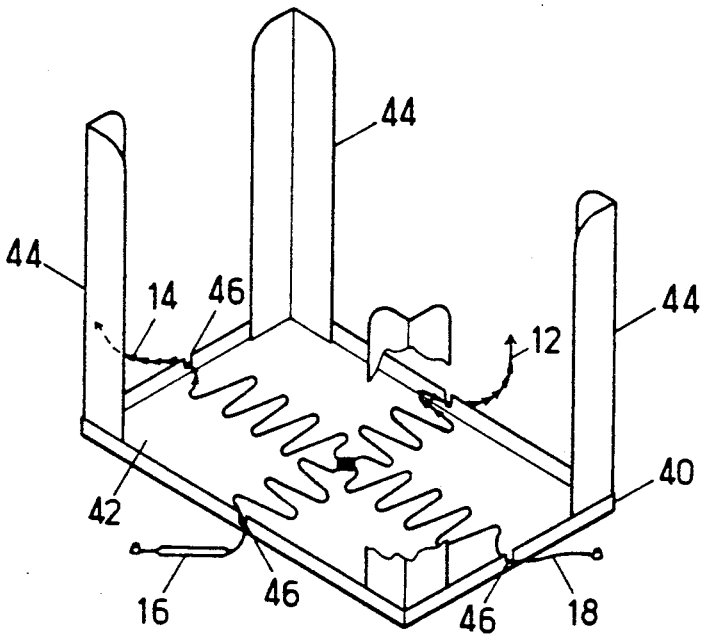
FIG. 7 a stacking fixture which may be used together bundling tie of FIG. 1 to form a bundling kit.
Figure 8:
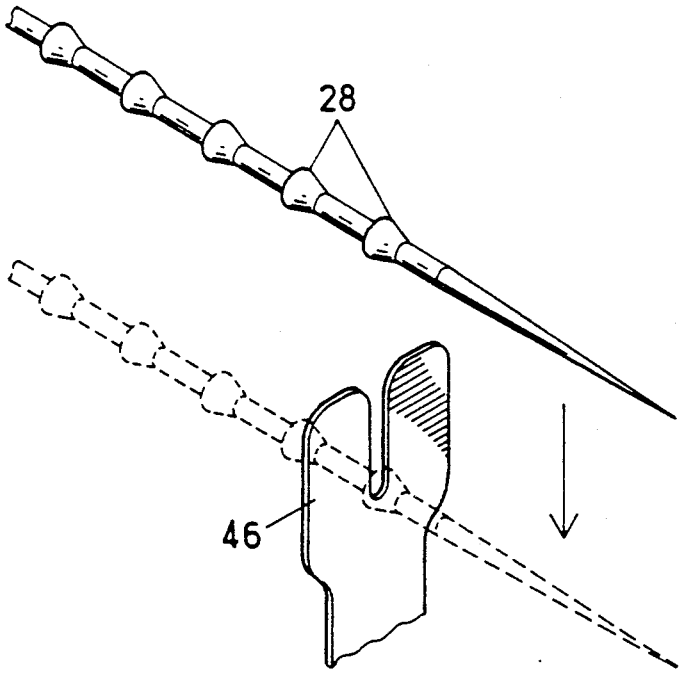
FIGS. 8 and 9 illustrate enlarged perspective views of the catches of the fixture of FIG. 7.
Figure 9:
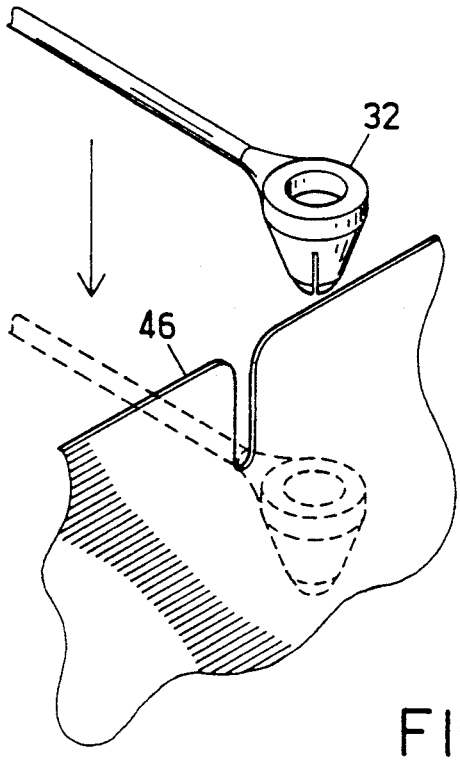

Shown in FIG. 7 is a stacking fixture intended to be utilized with the bundling tie 10 of FIG. 1 to form a bundling kit for stacked articles. The stacking fixture 40 includes a flat planar base unit 42 from which extend upwardly, at each of its corners, a stacking pillar 44. The shape of the base 42 and the stacking pillars 44 are selected so as to correspond to the size of the article to be stacked. At approximately mid-way along each of the side edges of the base unit 42 is located one of a set of four catches 46. Each of the catches 46 has a slot or passage of limited size, which is shaped and configured so as to be able to pinch and hold the appropriate one of the legs 12 through 18. Shown in FIGS. 8 and 9 are two embodiments of how such a pinch may be constructed. As shown in each of FIGS. 8 and 9, the catch 46 consists of a slot which is sized so as to permit the general material of the appropriate leg to pass therethrough, but which is of sufficient size so as to not permit either the catch 32, or one of the ridges 28, to pass therethrough.

Referring again to FIG. 7, it can be envisioned how the stacking fixture in accordance with the present operation is utilized with the bundling tie. The stacking fixture 40 is placed in the desired position. The bundling tie is then placed on the base 42 of the stacking fixture 40 and the legs 12 through 18 of the bundling tie 10 are stretched, as normal, prior to receipt of the stacking articles. As the legs of this bundling tie 10 are stretched outwardly, they are forced into the respective catches 46 on the stacking device 40, one of which is located adjacent to each leg. The catches 46 thus serve to hold the bundling tie with the legs in their extended or deformed positions so as to prevent their resilient return into the space saving configuration in FIG. 1. This makes the ends of the legs 12 through 18 readily available once the stack of articles is placed on the stacking fixture for fastening around the stack. The articles are then stacked. Then the legs 12 through 18 may be removed from the catches 46, stretched again to their full length, and fastened to each other over the stack of articles. In this way a tightly bundled and tied stack is obtained with minimal user effort.

Figure 10:
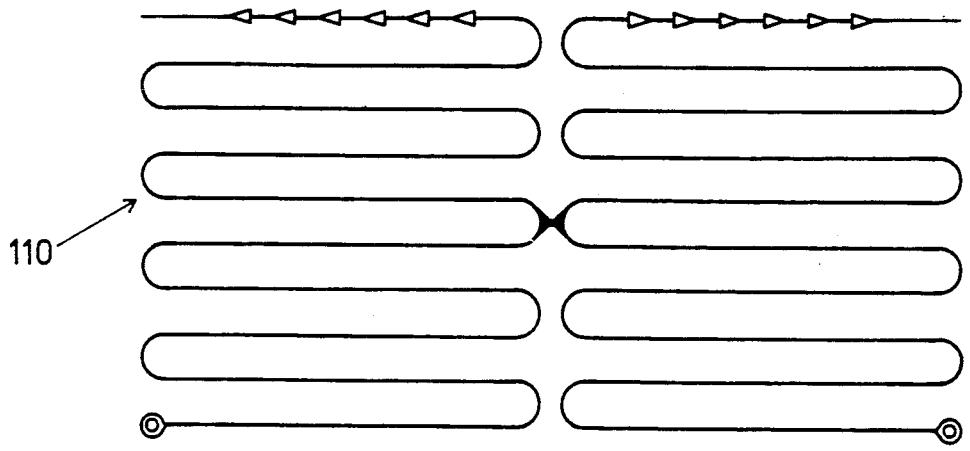
FIGS. 10 and 11 illustrate alternate coiling patterns for the legs of the bundling tie of FIG. 1.
Figure 11:
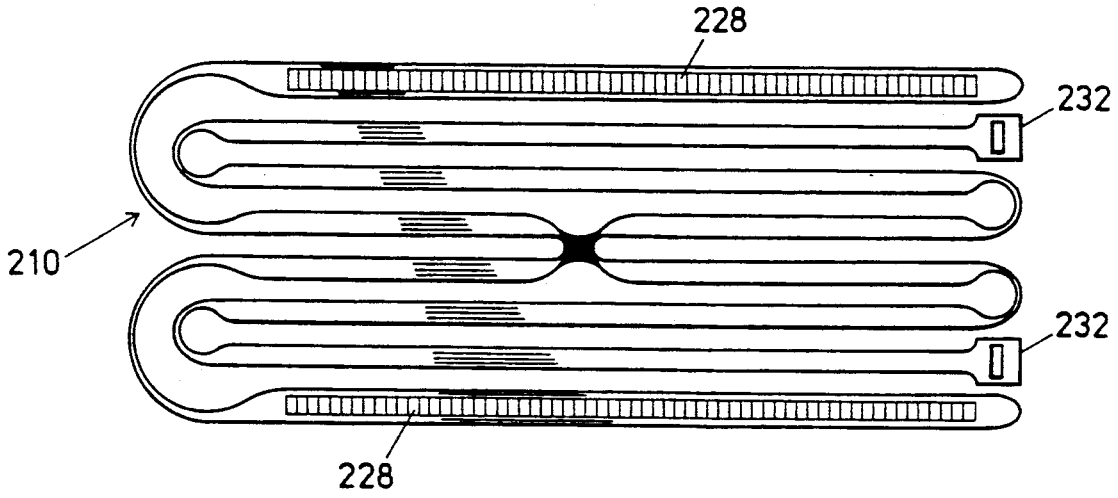

The remaining drawing figures illustrate various alternative embodiments for differing parts of the bundling tie of FIG. 1 without departing from the present invention. Shown in FIGS. 10 and 11 are two possible alternative embodiments 110 and 210 of patterns for the coiling of the legs of the bundling tie 10. Note that although the bundling ties 110 and 210 have different configurations or shapes of coiling, they both achieve the objective of a relatively long leg size coiled into a relatively small area. The fastener region of the legs on the bundling tie 210 is also slightly altered. Instead of the radial ridges 28 as were on the bundling tie 10 of FIG. 1, the ridges 228 of the bundling tie 210 are lateral raised bars. The clasp 232 of the bundling tie 210 is shaped accordingly to fasten over bar type, as opposed to radial, ridges in the fastener region.

Figure 12:
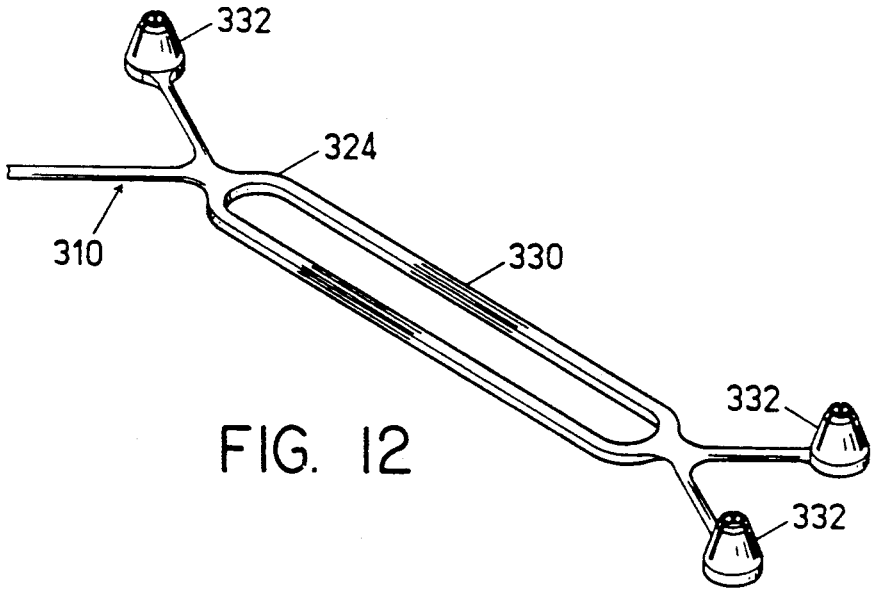
FIG. 12 illustrates a fastener region and FIG. 13 illustrates the operation of an alternative embodiment of a bundling tie.
Figure 13:
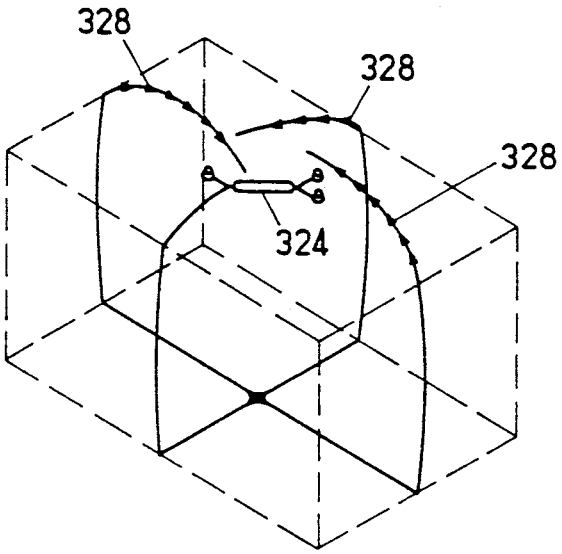

In the embodiment illustrated in FIGS. 12 and 13, a bundling tie 310 includes a single fastener region 324, includes three clasps 332 all formed adjacent a flat strip 330 serving as a handle. As is illustrated in FIG. 13, the fastener regions of the other three legs all fasten to the clasps 332 to tie up the bundle, leaving the handle 330 in place.

Figure 14:
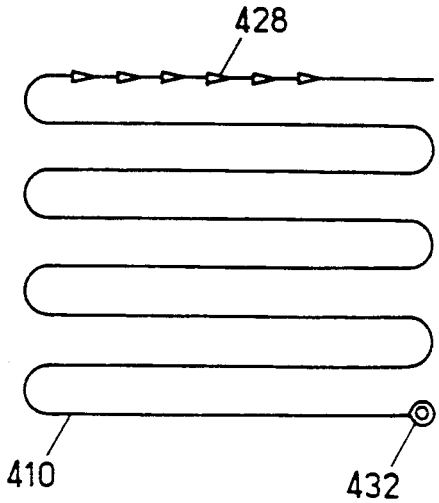
FIG. 14 illustrates an embodiment of the present invention including only two legs.

It is envisioned that a two legged bundling tie may be useful for some applications. For such a tie, as illustrated at 410 in FIG. 14, the center juncture is indefinite and a continuous coiled portion joins the two fastener regions. It would be possible to construct two of the two legged bundling ties 410 which have a mating fixture formed at their central junctures, so that the two two legged bundling ties could be mated together to form a single unitary four legged bundling tie.

It is further envisioned that other handles, tabs or handling provisions could be built into a bundling tie constructed in accordance with the present invention. A loop of plastic formed adjacent to the fastening means could help the users to easily stretch the legs. The handle portion could have apertures for other legs to be inserted therethrough. It is also envisioned that, to fix the bundling tie 10 in its configuration of FIG. 1, that breakable tabs could connect the legs outside of the central juncture. Such breakable tabs, which could be an aid in molding the article, would easily be ruptured by the user when the tie is used. Similar modifications in the shape, size, or arrangement of parts of the stacking fixture 40 are also possible.

It may be appreciated that the present invention is subject to additional modifications and variations with the scope of the present invention. Accordingly the embodiments presented herein are intended to be illustrative rather than limiting, the invention being interpreted in accordance with the present invention.

We claim:

1. A bundling tie molded as an injection molded thermoplastic article comprising a central juncture;

a plurality of legs extending outward from the central juncture, each of the legs including a coiled region in which the material of the leg is formed in a coiled serpentine pattern so as to minimize the area occupied by the leg, the coiled region of each of the legs being formed in a common plane so that the entire bundling tie is a planar object, the cross sectional size and material of the leg being selected so that the coiled region can readily be stretched out by hand by a user with the coiled region being deformed by such stretching; and fastening means located at the end of each of the legs opposite from the central juncture for fastening the ends of the legs together so that the bundling tie will encircle and bundle any items placed therein.

2. A bundling tie as claimed in claim 1 wherein there are four of the legs.

3. A bundling tie as claimed in claim 2 wherein the coiled region of each leg occupies a quadrant of area relative to the central juncture.

4. A bundling tie as claimed in claim 1 wherein one of the legs further comprises a flat strip which may be used as a carrying handle for the completed bundle.

5. A bundling tie as claimed in claim 1 wherein the fastener means comprises a conical clasp on an outward end of two of the legs and ridges on two other of the legs so that the legs with the ridges can be inserted through the conical clasps to fasten ends of the legs together.

6. A bundling tie integrally molded as a single piece of thermoplastic material comprising a central juncture;

four legs extending outwardly from the central juncture, each of the legs including a coiled region and a fastener region;

the coiled region of each of the legs being a serpentine pattern of sinusoidal coils formed in a single plane, so that the complete bundling tie when supplied to the user is a planar object, the material and cross sectional size of the coiled region being such that the coiled region can readily be deformed into an extended shape by a user;

the fastener region of each leg including fastening means to fasten to the fastener region of at least one other of the legs so that the legs may be bundled around and fastened over the articles to be bundled.

7. A bundling tie as claimed in claim 6 wherein the coiled region of each leg occupies a quadrant of area relative to the central juncture.

8. A bundling tie as claimed in claim 6 wherein one of the legs further comprises a flat strip which may be used as a carrying handle for the completed bundle.

9. A bundling tie as claimed in claim 6 wherein the fastener means comprises a conical clasp on an outward end of two of the legs and ridges on two other of the legs so that the legs with the ridges can be inserted through the conical clasps to fasten ends of the legs together.

* * * * *